US005918400A

United States Patent [19]

Schonberger

[11] Patent Number: 5,918,400

[45] Date of Patent: Jul. 6, 1999

[54] KIT FOR SHAPING AND MOUNTING PHOTOGRAPHS AND THE LIKE

[76] Inventor: Milton Schonberger, 1005 Ash Dr., Mahwah, N.J. 07430

[21] Appl. No.: 08/873,476

[22] Filed: Jun. 12, 1997

[51] Int. Cl.[6] ..... B44C 5/02; G09F 1/12

[52] U.S. Cl. ..... 40/711; 40/774

[58] Field of Search ..... 40/124.04, 711, 40/774, 773, 600

[56] References Cited

U.S. PATENT DOCUMENTS

| | | | |
|---|---|---|---|
| 1,943,022 | 1/1934 | Köster | 40/773 |
| 2,878,607 | 3/1959 | Alves | 40/773 |
| 3,187,449 | 6/1965 | Longo et al. | 40/600 X |
| 3,885,336 | 5/1975 | Olsen | 40/711 |
| 4,237,633 | 12/1980 | Murrell | 40/774 X |
| 4,332,095 | 6/1982 | Tanney | 40/773 X |
| 4,662,093 | 5/1987 | Suttles | 40/774 X |
| 4,663,874 | 5/1987 | Sano et al. | 40/600 X |
| 5,309,659 | 5/1994 | Eastman | 40/600 |

*Primary Examiner*—Joanne Silbermann
*Attorney, Agent, or Firm*—Ostrolenk, Faber, Gerb & Soffen, LLP

[57] ABSTRACT

A kit and a method of use of the kit for applying a full magnet backing to a photograph. The kit includes a mask with a first side with a cutout through it and a second side with either a cutout through it or an applied border outline on a then transparent second side. The border of the cutout in the second side or the applied on border of the second side overlying the border outline of the cutout in the first side. A magnet card of the size and shape of the cutout in the first side has adhesive on one surface thereof and is applied to the rear of the photograph held between the sides of the mask. The photograph is then trimmed to the edges of the magnet card.

13 Claims, 3 Drawing Sheets

FIG. 5
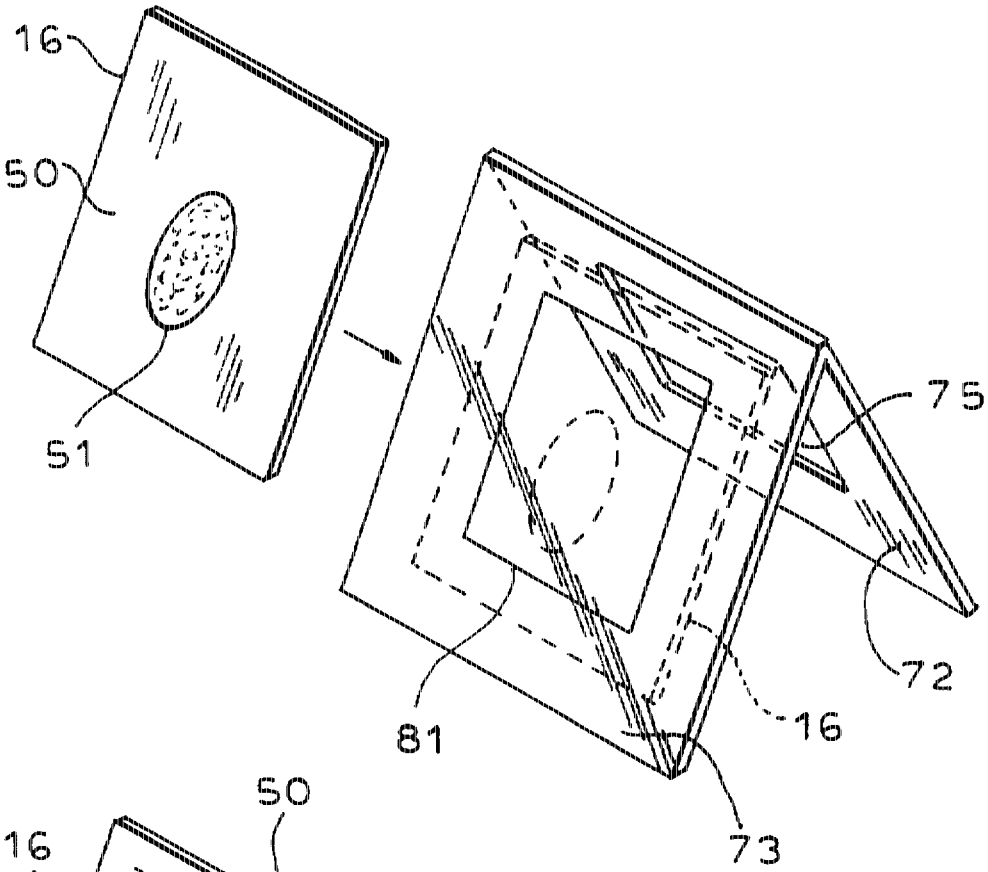
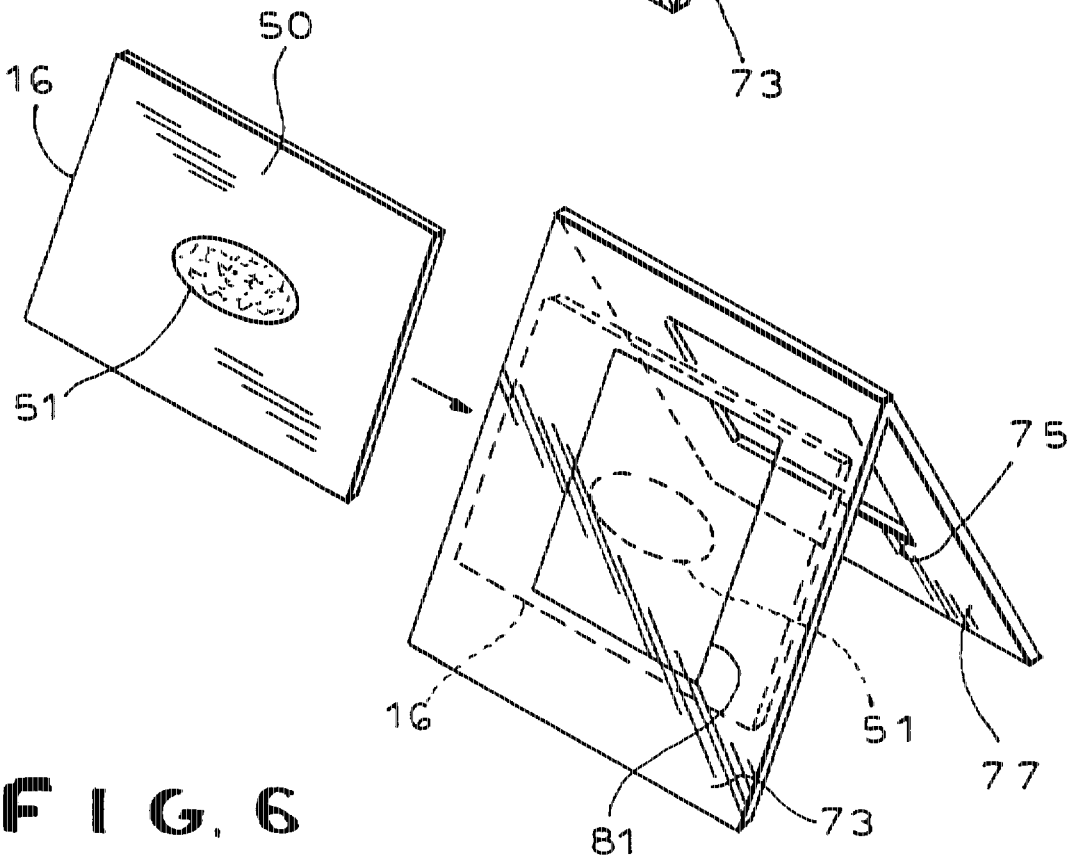
FIG. 6

KIT FOR SHAPING AND MOUNTING PHOTOGRAPHS AND THE LIKE

BACKGROUND OF THE INVENTION

The present invention relates to a kit for mounting photographs to a support, particularly a magnetic support, and for shaping the photograph to the support and for selectively cropping or reducing the photograph to a smaller size, with a more pleasing composition. Although the invention is described with reference to photographs, it may be used for any type of picture, or any paper or paper like article.

A photograph typically includes material which is the principal subject of the photograph and additional background or perhaps extraneous material. For example, a photograph may show a person, while the remainder of the photograph is possibly relevant background or possibly irrelevant background which may distract from the image of the person in the photograph. One can either ignore the irrelevant or undesired material, or one might manually trim the photograph to eliminate the undesired material. A kit for helping one to eliminate undesired material, to place the significant part of the photograph image at a desired location within the resulting reduced size photograph, and to shape and size the photograph in a selected manner is not available.

In addition, it is usual to mount a photograph (or other paper article) on a vertical surface like a wall, cabinet, board, and sometimes a metal surface, like a refrigerator door. However, as the photograph does not usually self adhere to the surface, some additional means for adhering the photograph (or for framing it and then adhering the frame) to another surface are used.

Frequently, people use magnets to mount photographs or other articles to a steel surface. One frequently sees photographs and paper articles mounted by magnets to surfaces of a refrigerator, to the surfaces of other metal appliances or other metal surfaces. Since photographs are not normally attached to or mounted on magnets, the photograph is typically supported between a magnet and the metal surface, with the magnet attracted to the metal surface and the photograph trapped between them. It is known to mount, adhere or laminate a photograph on a sheet of magnet material so that the mounted photograph might then itself adhere to the metal surface without the need for an additional magnet. No convenient kit for a person to mount his own photographs on a magnet is available.

SUMMARY OF THE INVENTION

Accordingly, it is an object of the invention to provide a kit for mounting a photograph or the like on magnet material enabling the photograph to be magnetically adhered to a metal surface, such as on a refrigerator.

It is another object of the invention to provide a kit for enabling a photograph, or the like, to be sized as desired.

A further object is to enable the user to eliminate undesired or extraneous material from a photograph and/or to crop it, so that the reshaped photograph might have a more pleasing composition, e.g. it might give selected subject matter in the photograph more prominence.

A primary object of the present invention is to combine the above features in an easily used kit.

The principal component of the kit is a mask for allowing the user to move the photograph around at the mask until a pleasing composition is obtained at a viewing region of the mask and for thereafter enabling the shaping of the photograph to retain only the selected composition.

In one version, the mask is made of two layers, e.g. it may be formed by a folded blank. The material of the mask may be either paper or stiff paper folded in half and punched through both of the first and second sides to form one selected size and shape cutout. The holes punched through both sides are of the same size and shape, and they are so placed that the borders defining the corresponding holes in both sides overlie.

In a second version, the mask is made of two layers, e.g. a folded sheet of a clear flexible plastic material that is folded in half. An alternate form of the second version includes only one transparent side. In the second version, only the first side need be punched to form the desired cutout. The other second side need not be punched. Instead, the second transparent side has a printed outline of the size and shape of the cutout in the first side. The printed outline is so placed on the second side that the outline overlies the border defining the corresponding hole in the first side, and the outline and the punched hole are aligned.

The second side of the mask in either version, i.e. with either a cutout in it or an outline on it, and below which the image to be viewed is positioned, may be transparent to enable the person using the mask to see in the opening or inside the outline that part of the photograph that will remain after later trimming of the photograph. The transparency of the second side will also enable the user to see the parts of the photograph that will be removed, so that the user could decide that some of the material in the photograph should be retained, not trimmed away, and the photograph would be shifted below the cutout or outline so that the desired parts of the photograph would be visible in the cutout or outline and later in the final trimmed, mounted photograph.

Stated in its broadest way, the first side of the mask has a cutout in it with a border, while the second side of the mask includes means defining a border which will overlie the border of the cutout in the first side when the first and second sides overlie. The border on the second side surrounds the portion of the image which the user wants to view in the finished composition. In the described embodiments, the means of the second side are either a cutout therein or an outline border on a transparent second side. Other means functioning as described herein may be provided for the second side.

A separate mask may be made for each desired finished size and shape. Alternatively, one mask may incorporate more than one finished size and shape.

The mask may have several cutouts of several different sizes and/or shapes. At least one of the selected shapes and sizes is that of a standard production photographic print, while other different sizes and shapes are selected by the designer of the particular kit, e.g., a particular geometric shape or a smaller size rectangle than the standard photograph shape and size.

The kit includes magnetic sheet material which may be cuttable, but is preferably pre-cut, into supplies of individual cards of magnetic material of predetermined shapes or sizes corresponding to the shapes and sizes of all of the cutout or cutouts in the first side of the mask.

The magnetic sheet material of which cards are formed is of a conventional variety, a thin sheet, which is thick enough not to be too floppy or flexible, but thin enough to be bent without cracking. A photograph or the like should be adherable to or otherwise attachable or laminatable on one surface of the magnet card, e.g., by an adhesive layer coated on the surface. The adhesive should be inactivated until needed, e.g., an adhesive layer may be covered by a removable release layer, which is removed just before the photograph is adhered on the magnetic sheet.

The final and optional component of a kit is a knife, a blade, scissors, or the like usable to trim or crop a mounted photograph to the shape of its applied magnet card support.

To use the kit, the user inserts a photograph, which is typically somewhat larger than the finished size and/or shape desired by the user, between the two sides, e.g. folded halves, of the mask with the photograph image facing the second side of the mask and being visible through a cutout where both sides have aligned cutouts or through the transparent side with a printed outline. The user rotates or moves the photograph beneath the cutout in or the outline on the second side until the pleasing composition is seen either through the cutout or inside the border defined by the outline. The unnecessary or undesired material of the photograph is either outside the cutout or the outline.

With the photograph held in that position at the mask, the mask is positioned to expose the cutout in the first side. An adhesively coated magnet card with the adhesive on one surface exposed is applied to the back side of the photograph through the cutout in the first side of the mask. The magnet card that is selected is of the same size and shape as the opening in the mask to fit in the opening and be adhered to the photograph below it. The mounted photograph is then either removed from the mask or left in the mask, and the photograph is trimmed with a knife, blade or scissors to the edges of the adhered magnet card. This eliminates the material that was outside either the cutout in or the printed outline on the second side of the mask and then leaves only the material that was encompassed by the border defining the opening in the mask or the printed outline. The result is a frameless photograph with a magnetic back which can be attached to any surface which would attract the magnet.

Other objects and features of the present invention will become apparent from the following description of the invention in conjunction with the accompanying drawings.

BRIEF DESCRIPTION OF THE DRAWINGS

FIGS. 5 and 6 illustrate use of the invention, with the mask of FIG. 4 reversed.

DESCRIPTION OF PREFERRED EMBODIMENTS

The kit of the invention is comprised of several components. It includes the mask 10, 30 or 70.

Figure 1:
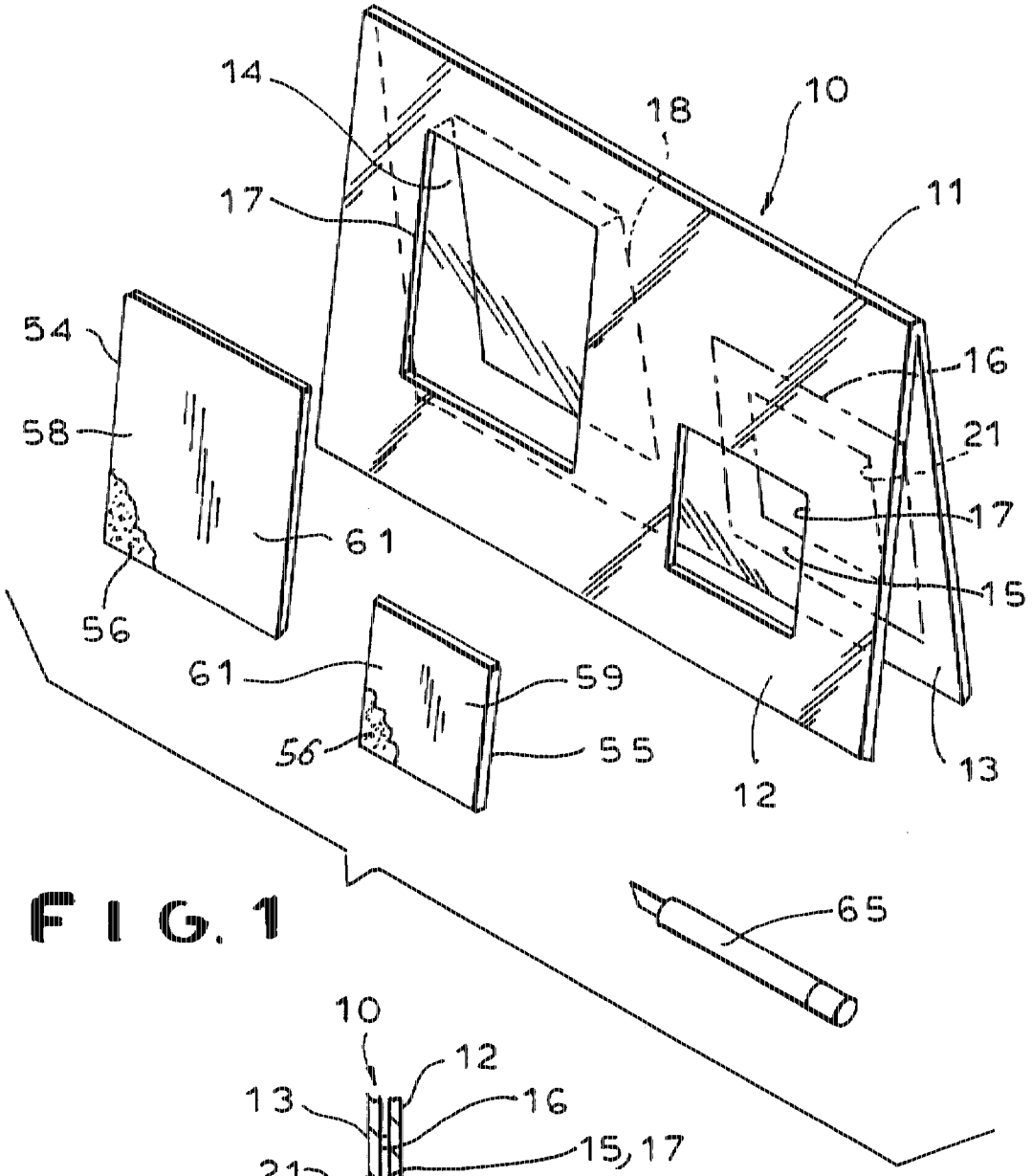
FIG. 1 is a perspective view of an assembly of the components of a first embodiment of the invention.

The kit embodiment in FIG. 1 has as its primary component a mask 10 comprised of a sheet of an appropriate transparent flexible plastic material, e.g. polystyrene, PVC or polypropylene, folded in half at 11. Alternatively, two sheets may be assembled overlaid to form a mask 10. The mask 10 in FIG. 1 has first and second sides 12 and 13. Both sides formed from a single folded sheet are transparent. However, if two sheets are assembled to define the mask, only the below described second side 13 need be transparent for being used in the same way as the embodiment of FIG. 1.

The first side 12 has at least one, and as illustrated in FIG. 1, several openings or cutouts 14, 15 of selected size and shape, which would be the desired final size and shape of a photograph mounted on a magnet using the kit. Any size and shape cutouts 14, 15 may be used, and each cutout can have any interesting geometric shape. It is preferable that the cutouts 14 and/or 15 be smaller than the original size of a photograph 16 to be sized or cropped at the mask 10 in order for the full benefit of the invention to be realized. A plurality of different size and shape cutouts 14, 15, etc. will accommodate different size and shape photographs and permit any desired interesting composition to be provided on the resulting mounted photograph. Each cutout has a border 17 defined as the cutout is formed.

The second transparent side 13 of the mask has no cutouts like 14, 15. Instead side 13 bears a first applied outline 18 of the same size and shape as the border of the cutout 14 in the side 12 and positioned to directly overlie the border 17 of the cutout. Similarly, the second side 13 has a second applied outline 21 of the same size and shape as and overlying the border 17 of the cutout 15 in the first side 12. If there are further cutouts in the first side 12, there are further corresponding outlines on the second side 13.

Figure 3:
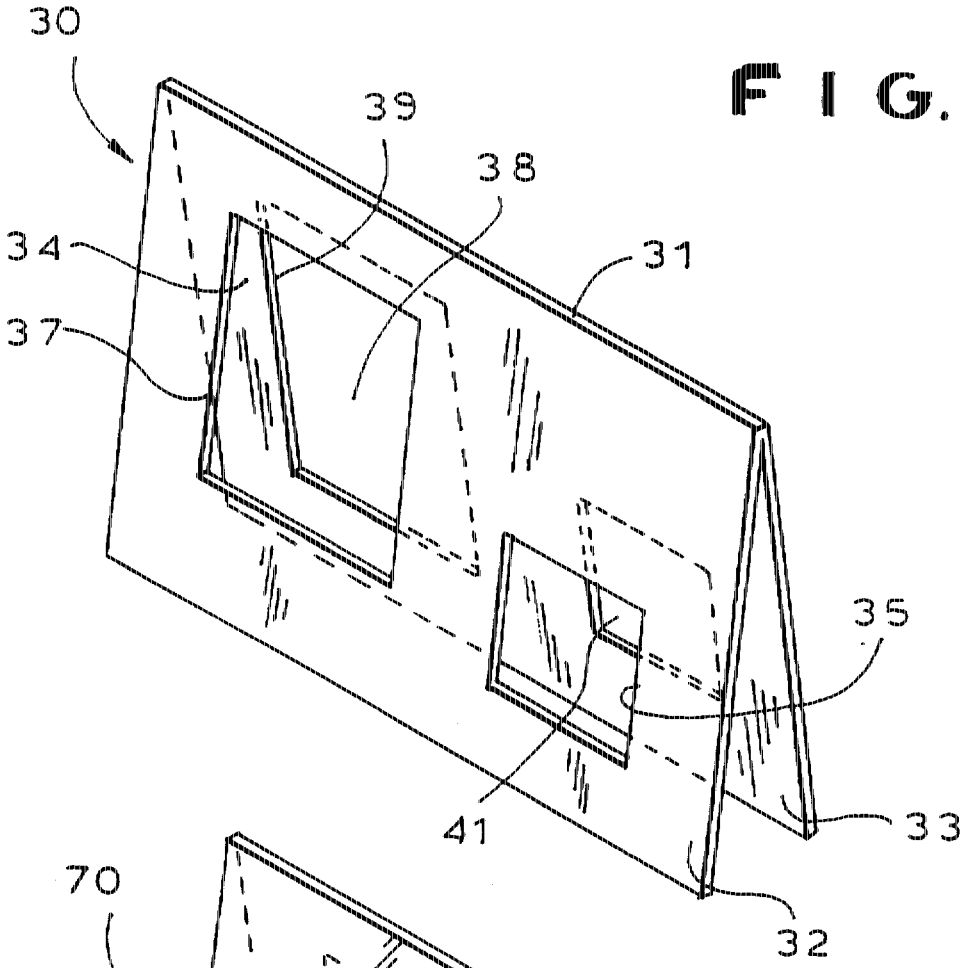
FIG. 3 is a perspective view of a second embodiment of a mask for the kit.

In the illustrated alternate embodiment of FIG. 3, the mask 30 is opaque paper, not transparent. It is folded at 31. The first side 32 corresponds to the first side 12 in FIG. 1 and has cutouts 34 and 35 bordered by borders 37 and corresponding to cutouts 14, 15, respectively. In place of the applied outlines 18 of FIG. 1, the second side 33 in FIG. 3 also has cutouts 38 and 41 which are placed so that the borders 37, 39 of the corresponding cutouts 34, 38 and 35, 41 in both sides 32 and 33 overlie each other.

Figure 2:
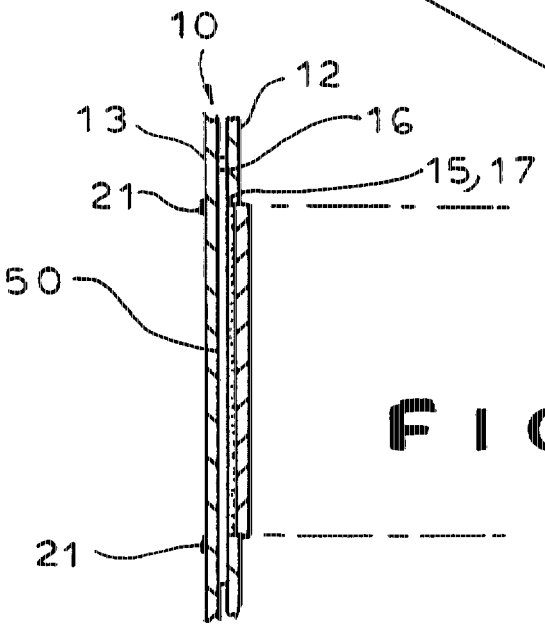
FIG. 2 is a side cross-sectional view of the mask of the first embodiment during the use of the kit.

To use the mask 10 of FIGS. 1 and 2, a photograph 16 is placed between the sides 12 and 13 of the mask 10, with its front image side 50 facing the second mask side 13 so that the front side of the photograph could be viewed through the transparent second side 13. The photograph 16 is rotated and moved with reference to a selected one of the outlines 21 on the second side 13 until the selected composition and desired portion 51 of the entire image on the photograph is positioned in the outline 21. This technique is illustrated in FIGS. 5 and 6. With the photograph 16 held in position, e.g. by squeezing the sides 12 and 13 together against the photograph, the mask 10 is then moved to expose the respective cutout 15 in the first side 12 beneath which the rear of the photograph lies.

A magnet card 54 or 55 has been formed to correspond respectively to the size and shape of a respective cutout 14 or 15, i.e., it is just slightly smaller than the cutout so that the card can pass through the cutout. The card has adhesive 56 on one respective surface 58 or 59. The adhesive may be covered by a protective paper layer 61, which is removed before use to expose the adhesive 56. The adhesive covered surface is applied to the rear side of the photograph through the cutout 15 to fix the photograph on the magnet. The sides of the mask are separated sufficiently to permit removal of the mounted photograph on the magnet from the mask. Thereafter, the knife 65 is used to trim the photograph to the edges of the magnet. Alternatively, the photograph may be trimmed before being removed from the mask by passing the knife blade through the cutout 15 and using a slight gap between the magnet card 55 and the border 17 of the cutout 15 to guide the path of the knife blade for trimming the photograph adhered to the card.

The alternate embodiment of FIG. 3 is used in essentially the same manner. The front of the photograph faces one of the sides 32, 33 and the photo is positioned to expose the selected part of the photograph in a cutout in that side. The magnet card 54, 55 is applied to the rear of the photograph through the corresponding cutout in the other side of the mask. The respective corresponding cutouts in the two sides overlie, so that the magnet card will be applied to the back of the selected part of the photograph.

Figure 4:
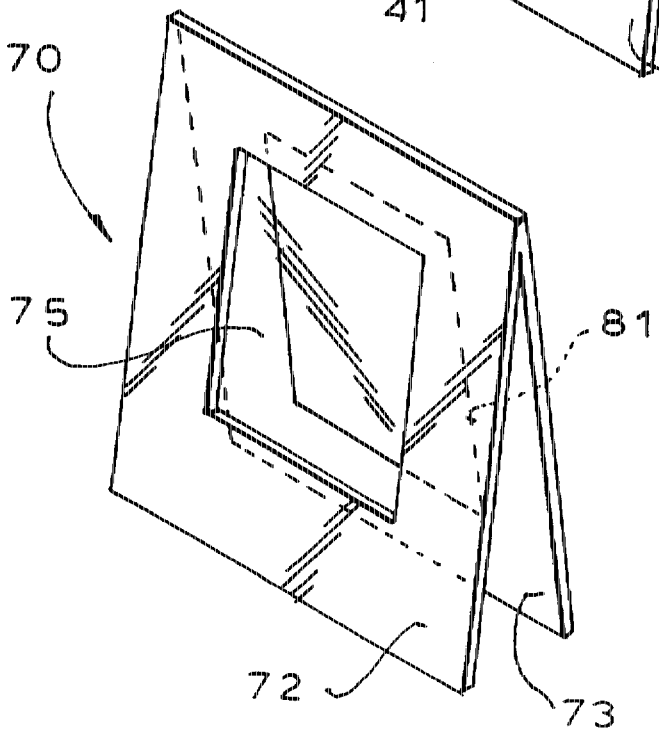
FIG. 4 is a perspective view of a third embodiment of a mask.

The alternate embodiment of FIG. 4 is like the embodiment of FIG. 1, except that the mask 70 has a single cutout 75 at a first side 72 and a correspondingly positioned and printed outline 81 on the second side 73 which would overlie the cutout 75 when the sides 72 and 73 are folded together. In place of the applied outline 81 indicated, and if the mask 70 is opaque as in the second embodiment, the outline 81 is replaced with a cutout, as in the embodiment of FIG. 3, which would expose the front of the photograph to view. The kit of FIG. 4 would require only one magnet card size and shape.

FIGS. 5 and 6 illustrate possibilities, using the mask 70 of FIG. 4, of orienting the photograph 16 with the major part 51 of the image 50 at different positions and orientations. Before the magnet card is applied, the image is repositioned inside the outline 81 to select the desired composition. Then the magnet card is applied through the cutout 75.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A kit for sizing a photograph or picture and for mounting the photograph or picture on a magnet backing the kit comprasing:

a supply of magnetic mounting cards including a magnet thereon, whereby each card is adapted for being magnetically supported to a metal surface, each card being of at least one selected size and shape;

a mask for enabling selection of a desired portion of the photograph to be mounted on one of the cards and for selecting a desired portion of the photograph to be retained against the magnet, the mask including a first and a second side for overlying one another with a photograph placed between them;

the first side having at least one cutout therein defined by a border of the cutout in the first side, the cutout having one selected size and shape of at least one of the cards, whereby the one card may be passed through the opening in the one surface;

means on the second side of the mask having the same size and shape as the border of the cutout in the first side, and with the first and second sides overlying, the means on the second side being aligned with the border of the cutout in the first side, the means enabling the user to view the photograph or picture which is bordered by the means by looking at the second surface, which enables the user to position the photograph or picture between the first and second sides while looking at the photograph or picture bordered within the means on the second surface;

means for attaching the magnetic mounting card to the side of the photograph or picture facing toward the first side when the card is passed through the cutout of the first side to contact the photograph.

2. The kit of claim 1, further comprising means for cutting the photograph to trim it to a desired size and shape.

3. The kit of claim 1, wherein the mask is comprised of transparent material and the means on the second side comprises an outline, the outline being of the same size, shape and overlying the border of the cutout in the first side.

4. The kit of claim 1, wherein the means on the second side comprises a second cutout in the second side which is defined by a second border in the second side, the second border is so shaped and placed on the second side as to overlie the border of the cutout in the first side, whereby the cutouts of the first and second sides are the same size and shape and overlie each other.

5. The kit of claim 1, wherein the means on the second side comprises a viewing area in the second side which is defined by a border in the second side that is of the same size and shape and that overlies the border of the cutout in the first side when the first and second sides overlie each other.

6. The kit of claim 1, wherein there are a plurality of the cutouts in the first side, each cutout being of a respective size and shape; a respective plurality of the means in the second side each having a border in the second side overlying the border of a respective cutout in the first side; and at least one respective one of the cards shaped to the respective size and shape of each of the cutouts.

7. The kit of claim 1, wherein the means for attaching the magnet card to the side of the photograph or picture comprises adhesive on the one side of the card.

8. The kit of claim 7, further comprising a releasable cover layer over the adhesive on the card.

9. A method for applying a photograph or picture to a magnetic mounting card comprising:

positioning the photograph or picture, which has an image between two sides of a mask, wherein the first side of the mask has a cutout of a desired size and shape and the second side of the mask has means with a border of the same size and shape and overlying the border of the cutout in the first side, the photograph, picture being positioned so that the image can be viewed at the second side within the border defined by the means of the second side;

with the photograph positioned, attaching a magnetic mounting card of the same shape and size as the respective cutout in the first side to the rear of the photograph or picture, whereby the photograph or picture is mounted to the magnetic mounting card;

trimming the photograph picture, around the edges of the magnetic mounting card whereby the photogaph on the card has a desired similar shape; and whereby the mounted photograph may be magnetically supported on a surface.

10. The method of claim 9, wherein the means of the second side comprises a cutout with the same size and shape as and which overlies the border of the cutout in the first side.

11. The method of claim 9, wherein the second side is transparent and the means on the second side comprises a border applied on the second side and shaped and positioned to overlie the border of the cutout in the first side.

12. The method of claim 9, wherein the photograph or picture, is trimmed while it is between the sides of the mask by trimming through the gap between the card and the photograph or picture.

13. The method of claim 9, further comprising removing the photograph or picture, from between the sides of the mask and then trimming it.

* * * * *